US010415303B2

(12) United States Patent
Hall et al.

(10) Patent No.: US 10,415,303 B2
(45) Date of Patent: Sep. 17, 2019

(54) CORDLESS WINDOW BLINDS WITH ELECTROMAGNETS TO CONTROL RAISING, LOWERING, AND TILT OF SLATS

(71) Applicants: David R. Hall, Provo, UT (US); Emily Brimhall, Alpine, UT (US); Terrece Pearman, Draper, UT (US)

(72) Inventors: David R. Hall, Provo, UT (US); Emily Brimhall, Alpine, UT (US); Terrece Pearman, Draper, UT (US)

( * ) Notice: Subject to any disclaimer, the term of this patent is extended or adjusted under 35 U.S.C. 154(b) by 364 days.

(21) Appl. No.: 15/479,698

(22) Filed: Apr. 5, 2017

(65) Prior Publication Data

US 2018/0291677 A1 Oct. 11, 2018

(51) Int. Cl.

| | |
|---|---|
| ***E06B 9/322*** | (2006.01) |
| ***E06B 9/386*** | (2006.01) |
| ***E06B 9/327*** | (2006.01) |
| ***E06B 9/302*** | (2006.01) |

(52) U.S. Cl.

CPC ..... *E06B 9/322* (2013.01); *E06B 9/302* (2013.01); *E06B 9/327* (2013.01); *E06B 9/386* (2013.01); *E06B 2009/3222* (2013.01)

(58) Field of Classification Search

CPC ..... E06B 9/322; E06B 2009/3222; E06B 2009/2646; E06B 9/02; E06B 9/266; E06B 9/368; E06B 9/68; E06B 9/70; E06B 9/72; E06B 9/74

See application file for complete search history.

(56) References Cited

U.S. PATENT DOCUMENTS

| | | | | |
|---|---|---|---|---|
| 8,844,603 | B1 * | 9/2014 | Anti | E06B 9/307 160/176.1 R |
| 2007/0175599 | A1 * | 8/2007 | Froese | E06B 9/386 160/168.1 R |
| 2014/0083630 | A1 * | 3/2014 | Wu | E06B 9/322 160/84.04 |
| 2015/0101767 | A1 * | 4/2015 | Chen | E06B 9/323 160/370 |
| 2016/0237741 | A1 * | 8/2016 | Greene | E06B 9/322 |
| 2018/0258693 | A1 * | 9/2018 | Hall | E06B 9/386 |

* cited by examiner

*Primary Examiner* — Phi D A

(57) ABSTRACT

We disclose a cordless window blind that includes at least one electromagnet within each slat. The slats may be inserted into orifices within rotatable slat mounting members on a vertical guide rail assembly. The orifices may house electrical connections which connect the electromagnets to at least one battery. The electromagnets may have the same polarity such that the electromagnet of one slat attracts the electromagnet of an adjacent slat. The magnetic attraction may move one slat toward the other slat causing the slats to move vertically along the guide rail assembly and either raise or lower the blinds. Alternatively, electromagnets on only one of two longitudinal edges of the slats may be actuated and attract a metal member on an adjacent slat. The magnetic attraction may cause the slats to tilt and rotate within the slat mounting members thus closing the blinds.

20 Claims, 12 Drawing Sheets

CORDLESS WINDOW BLINDS WITH ELECTROMAGNETS TO CONTROL RAISING, LOWERING, AND TILT OF SLATS

BACKGROUND

Field of the Invention

This disclosure relates to window blinds, particularly window blinds that are automated and cordless.

Background of the Invention

Standard window blinds typically include cords. Even the so-called cordless blinds often include tilt strings which provide support for the slats and provide a mechanism for tilting the slats to close the window blinds. Exposed cords in blinds detract from the aesthetics of the window treatment and, more importantly, represent a safety hazard for children who may become entangled in the cords and strangle. A blind that is devoid of exposed cords is needed.

Window blinds which require manual adjustment of the slats to lift, lower, or tilt the slats represent a level of inconvenience. A window blind which is powered by electricity, for example, by battery power is desirable. While window blinds which perform some functions using battery power are known in the art, a more convenient window blind which may raise, lower, and tilt the slats while being truly devoid of exposed cords is needed.

BRIEF SUMMARY OF THE INVENTION

We disclose a window blind which may be battery-controlled and may have no exposed cords. The window blind may include a headrail and multiple slats. The slats may include one or more electromagnets. The core of the electromagnets may be inserted into channels that may connect a top surface to a bottom surface of the slat. The electromagnets may each include a core and a wire wrapped around the core with one of the two ends of the wire extending from each end of the core. The ends of the wire may be in electrical connection with a battery. The window blinds may further include switches which may either complete or break a circuit including at least one battery and at least one electromagnet. A controller may modulate the switches to actuate or inactivate the electromagnets.

The ends of the slats may be inserted into orifices within each of a plurality of rotatable slat mounting members. The rotatable slat mounting members may be located between two guide rails. The guide rails may be mounted on each of two side panels which extend downward from the ends of the headrail. The orifices may include electrical connections which may electrically connect the ends of the wires which extend from the electromagnets to the one or more batteries. The rotatable mounting members may rotate when the slats tilt providing the slats with freedom of movement. The rotatable mounting members may slide vertically between the two guide rails on each side panel to enable the slats to raise and lower.

The electromagnets may, at least in part, control the tilting, raising, and lowering of the slats. For example, when all the electromagnets are actuated and have the same polarity, the slats may be attracted to each other and stack up. The top slat may be vertically immobile so that the lower slats stack below the top slat. The slats may be raised in this way.

Alternatively, the electromagnets on a longitudinal edge of each of the slats may be actuated while the electromagnets on the opposite longitudinal edge of each of the slats may be inactivated. A metal member may be attached to each slat. In some embodiments, the metal member may be on the bottom surfaces of the slats and along the longitudinal edges which have the inactive electromagnets. Instead of the electromagnets being attracted to each other, the electromagnets of one slat may be attracted to the metal member of the slat above it. The longitudinal edge of the lower slat and the opposite longitudinal edge of the upper slat may move toward each other causing the slats to tilt.

DETAILED DESCRIPTION OF THE INVENTION

Definitions

Figure 1:
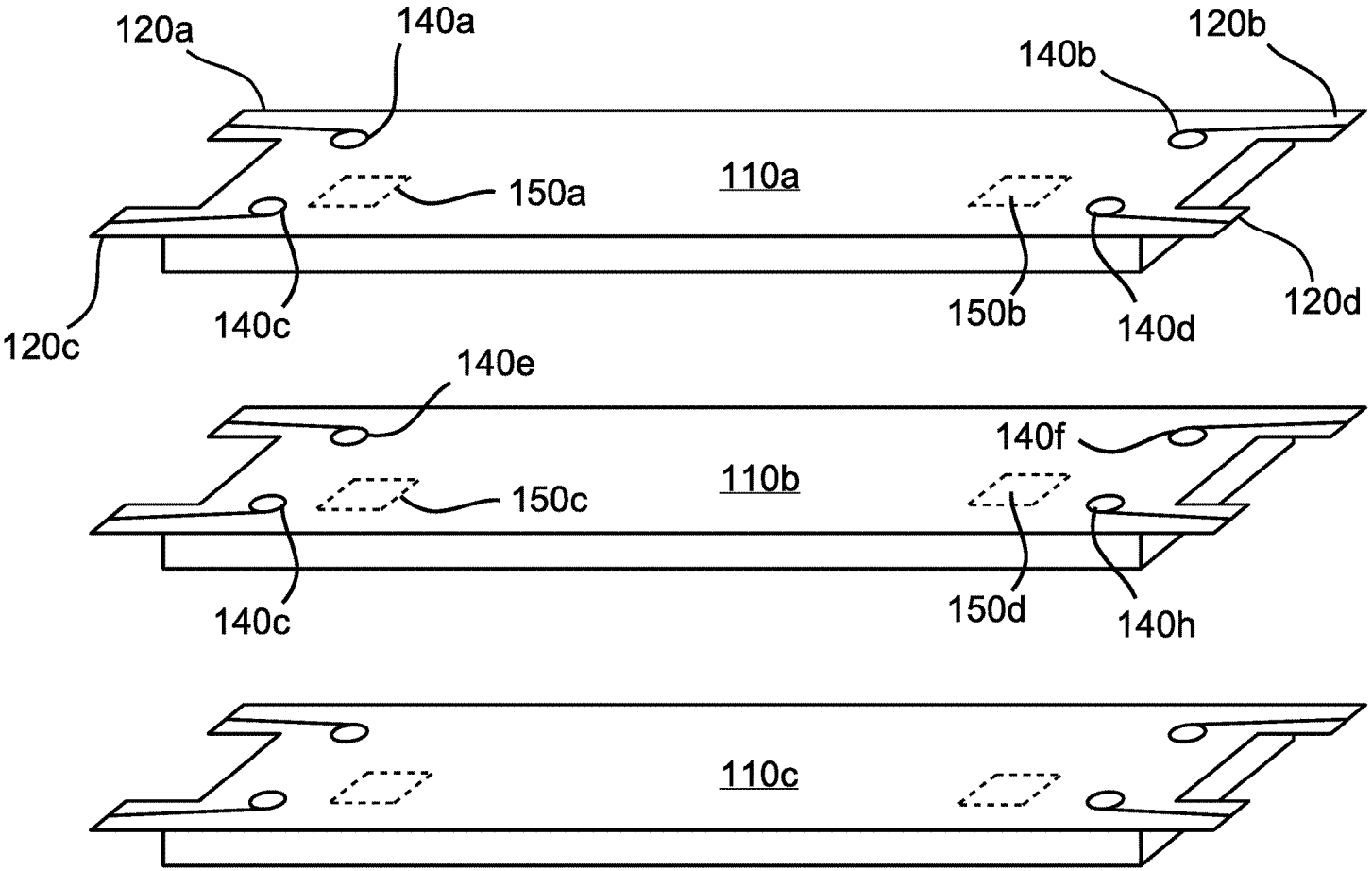
FIG. 1 illustrates an embodiment of three slats which may be included in the disclosed window blind.

Window blind, as used herein, means a blind that covers an opening in a building, including a window or door.

While this invention is susceptible of embodiment in many different forms, there are shown in the drawings, which will herein be described in detail, several specific embodiments with the understanding that the present disclosure is to be considered as an exemplification of the principals of the invention and is not intended to limit the invention to the illustrated embodiments.

We disclose a window blind that has no exposed cords to present a safety hazard or detract from the aesthetic pleasure of the window blind. The window blind may include a headrail with two ends. A side panel may extend downward from each of the two ends of the headrail. The window blind may include one or more batteries. In some embodiments, the one or more batteries may be housed within the headrail.

Each of the side panels may include a guide rail assembly. Each guide rail assembly may include two guide rails which may be parallel to each other and which may be approximately perpendicular to the headrail and approximately parallel to the side panels. The side panels may include a plurality of rotatable slat mounting members. The rotatable slide mounting members may be mounted between the guide rails in each side panels. Each rotatable slat mounting member may include an orifice for inserting an end of a slat and each orifice may include a plurality of electrical connections. Each end of a slat may be inserted into a rotatable slat mounting member that is mounted within a different side panel.

Each window blind may include multiple slats each of which may include a top surface, a bottom surface, two transverse edges, and both a front and a rear longitudinal edge. Each slat may include multiple electromagnets which may be in electrical connection with the one or more batteries. Each of the electromagnets may have identical polarity.

The window blinds may include at least one switch which may be located between the one or more batteries and the electromagnets. The switches may control the currents flowing between the one or more batteries and the electromagnets. Consequently, the switches may actuate or inactivate the electromagnets.

The electromagnets may include a core and a wire wrapped around the core with each end of the wire extending from a different end of the core. In some embodiments, the electromagnets may be inserted into channels that extend through the thickness of the slat connecting the top surface with the bottom surface of the slat. There be at least two channels and an electromagnet may be inserted through each channel.

In some embodiments, the slats each include multiple tabs. The tabs may extend from each of the two transverse edges of each slat. For example, a tab may extend laterally from each corner of the slat. Consequently, two tabs may extend from each transverse edge of each slat, the tabs being parallel to the longitudinal edges of the slat. The tabs on each end of each slat may be inserted into a rotatable slat mounting member.

The ends of the wire extending from each end of the core of each electromagnet may extend out onto a tab. For example, because the core may be inserted into a channel that extends from the top surface to the bottom surface of the slat, one end of the wire may extend from the core out onto a bottom surface of a tab and the other end of the wire may extend out onto a top surface of the same tab. In some embodiments, at least one of the multiple electromagnets on each slat may be positioned at or near a corner of the slat. Some embodiments may include an electromagnet at each corner of the slat. In some embodiments, electromagnets may be positioned along each of the front and the rear longitudinal edges of a slat.

When the tab is inserted into the orifice within the rotatable slat mounting member, the ends of the wires may each come in contact with an electrical connection within the orifice. The connection may provide current from the at least one battery to the electromagnet.

Each of the slats may further include at least one metal member. In some embodiments, the metal members may include steel, iron, or a combination of both steel and iron. In some embodiments, the at least one metal member may be located on the bottom surface of each slat. In some embodiments, a metal member may further be located along on the bottom surface of a slat along the front longitudinal edge, the rear longitudinal edge, or both the front and rear longitudinal edges.

Referring again to the at least one switch, each of the at least one switch may complete a circuit between one or more electromagnet and at least one battery when in a closed position. Furthermore, the switch each of the at least one switch may break a circuit between one or more electromagnet and at least one battery when in an open position. In some embodiments, the window blind may include multiple switches and each switch may be a designated switch which is designated to control a single, specific electromagnet.

The disclosed window blind does not include tilt strings although the slats may be tilted to block incoming light. In some embodiments, the window bind includes a controller. In some embodiments, the controller may be located within the headrail. The controller may be connected to and modulate the at least one switch. In one embodiment, the slats may tilt to at least partially block light passing through the blinds as follows. The controller may close the switches that control the current flow to electromagnets which are positioned along the rear longitudinal edge of the slats. The controller may also open the switches that control the current flow to the electromagnets which are positioned along the front longitudinal edge of the slats. Consequently, the electromagnets that are positioned along the rear longitudinal edges of the slats may be actuated and the electromagnets that are positioned along the front longitudinal edges of the slats may be inactivated.

The electromagnets that are positioned along the rear longitudinal edge of a first slat may be attracted to the one or more metal members on the bottom surface of a second slat. The first slat may be adjacent to and may be the slat immediately below the second slat. The one or more metal members on the second slat may be located along the front longitudinal edge of the second slat on its bottom surface. Consequently, the rear longitudinal edge of the first slat may move toward the metal member of the second slat. This may cause the first and second slats to tilt towards each other. The rotatable slat mounting members into which the first and second slats are inserted may rotate as the slats tilt allowing the indicated longitudinal edges of the slats to move freely towards each other. The indicated longitudinal edges of the first and second slats may come into contact with each other causing the slats to close and block light from entering through the window blind.

The slats of the disclosed window blind may be raised and lowered as follows. The electromagnets on both longitudinal edges of each slat may be actuated. In some embodiments, the controller may close the switches causing the electromagnets to actuate. The electromagnets from adjacent slats may be attracted to each other through the magnetic forces. The slats may move vertically toward each other by moving vertically along the guide rail assembly. In some embodiments, the top slat may be vertically immobile so that the slats below it may stack below the top slat and completely open the window blind.

Referring now to the drawings, FIG. 1 illustrates slats 110*a*, 110*b*, and 110*c* which represent embodiments of slats of a window blind according to the disclosure. The slats are shown with the tilt such that the slats are in an open position. Each of slats 110*a*, 110*b*, and 110*c* has four tabs, each tab extending from one of four corners of the slat. Slat 110*a* includes tabs 120*a*, 120*b*, 120*c*, and 120*d*. Each of slats 110*a*, 110*b*, and 110*c* includes four electromagnets. The core of each electromagnet extends through the thickness of either slat 110*a*, 110*b*, or 110*c*. Slat 110*a* includes electromagnets 140*a*, 140*b*, 140*c*, and 140*d*. Slat 110*b* includes electromagnets 140*e*, 140*f*, 140*g*, and 140*h*. Tabs of slat 110*b* are not numbered for purposes of clarity. Electromagnets and tabs of slat 110*c* are not numbered for purposes of clarity. Each of slats 110*a*, 110*b*, and 110*c* further includes two metal members. Slat 110*a* includes metal member 150*a* and 150*b* while the metal members of slats 110*b* and 110*c* are not numbered for clarity.

Figure 2A:
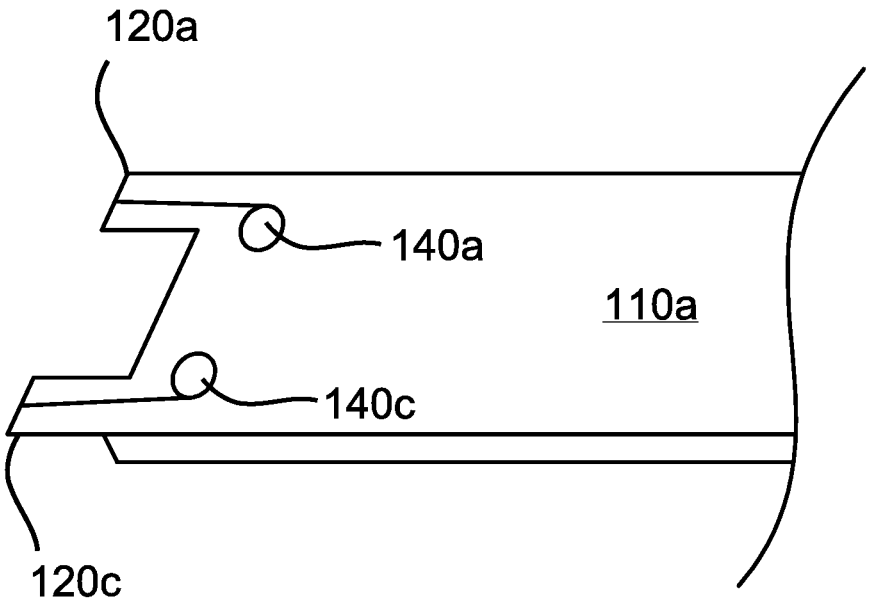
FIG. 2A illustrates an aerial close-up view of an end, including a transverse edge, of one of the slats of FIG. 1.
Figure 2B:
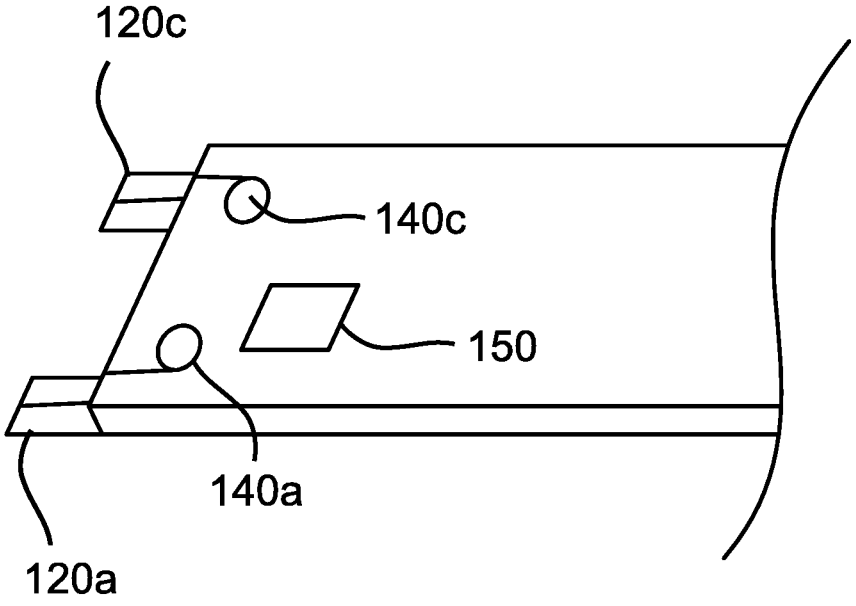
FIG. 2B illustrates the slat of FIG. 2A as viewed from below.

FIGS. 2A and 2B show an expanded view of one end of slat 110*a* of FIG. 1. FIG. 2A is a view from the top surface of slat 110*a*. Tabs 120*a* and 120*c* are shown as well as electromagnets 140*a* and 140*c*. Electromagnets may include a wire coiled around a core with a first end and a second end of the wire extending from the core. FIG. 2A shows a first end of each of electromagnet 140*a* and 140*c* extending from the top end of each core to the end of tabs 120*a* and 120*c* on their top surface.

FIG. 2B shows the slat of FIG. 2A from the bottom surface of the slat. Electromagnets 140*a* and 140*c* are shown with a second end of the wire extending from the bottom end of the core of the electromagnet onto tabs 120*a* and 120*c* on their bottom surface. In addition, metal member 150 is shown on the bottom side of slat 110*a*. In some embodiments, electromagnets on an adjacent slat may attract metallic member 150 causing the slats to tilt and close the slats.

Figure 2C:
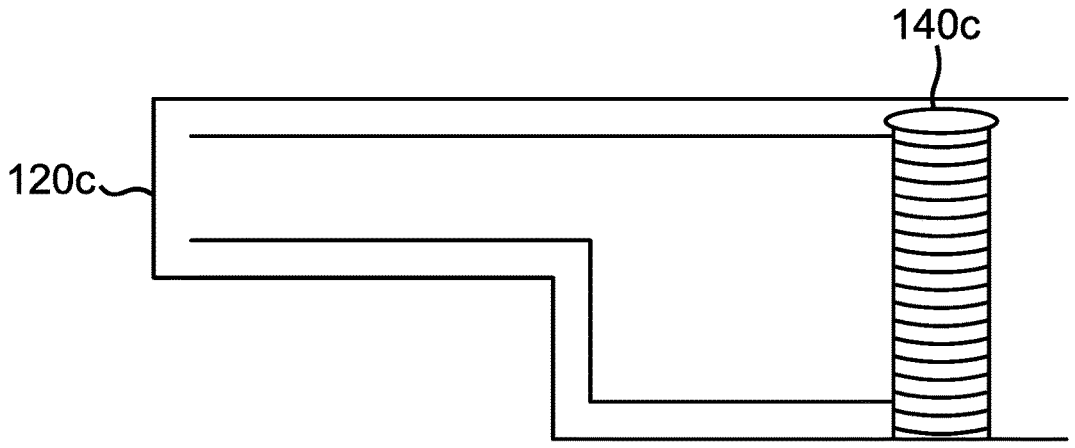
FIG. 2C illustrates a tab on the slat of FIG. 2A with an expanded cross-sectional view of the electromagnet.

FIG. 2C is an expanded cross-sectional view of tab 120*c* and electromagnet 140*c*. Electromagnet 140*c* is illustrated as a core with a wire wrapped around it. The two ends of the wire extend onto the top surface and bottom surface of tab 120*c*.

Figure 3A:
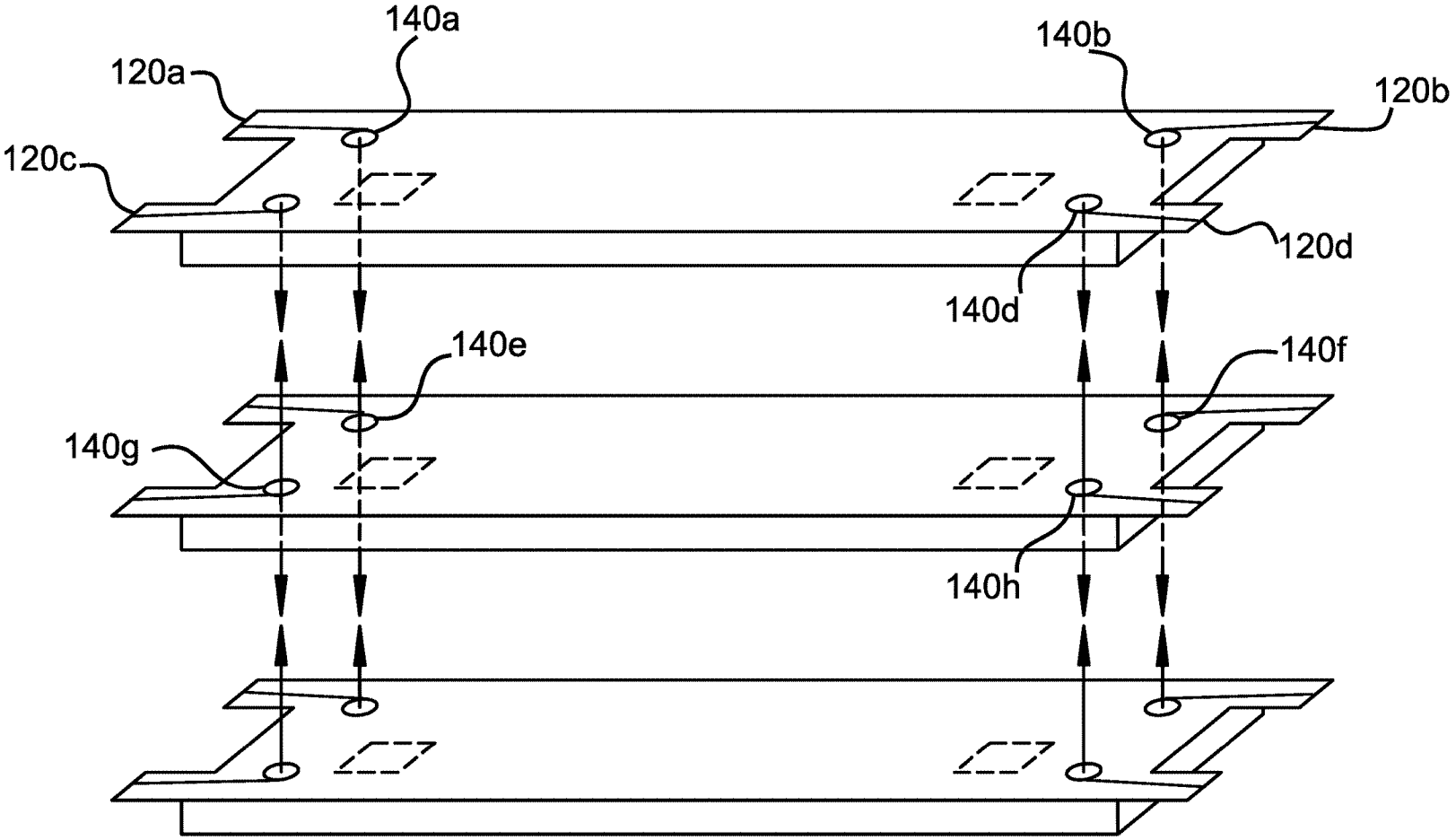
FIG. 3A illustrates the three slats of FIG. 1 in a fully open position just prior to raising the slats.

FIG. 3A illustrates the slats of FIG. 1 with each of electromagnets 140*a*, 140*b*, 140*c* and 140*d* of slat 110*a* actuated, each of electromagnets 140*e*, 140*f*, 140*g* and 140*h* of slat 110*b* actuated, and each of the electromagnets of 110*c* (not numbered for clarity) actuated. All the electromagnets have the same polarity. Therefore, opposite ends of electromagnets attract each other. Arrows indicate the direction of the attractive magnetic forces. Note that the metal members are shown as squares with dashed lines. The dashed lines indicate that the metal members are located on the bottom surface of the slats in this embodiment and would not be visible from above.

Figure 3B:
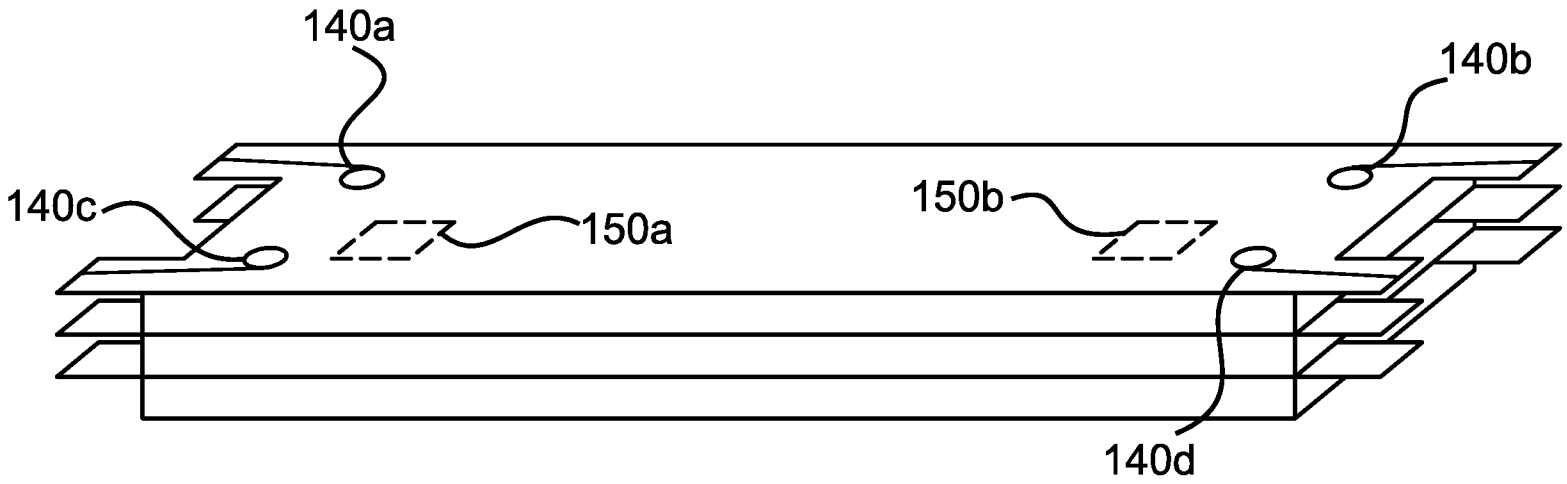
FIG. 3B illustrates the three slats of FIG. 3A after the slats have been raised.

FIG. 3B illustrates the slats of FIG. 3A after they have responded to the magnetic forces. The three slats have moved together in response to the attractive magnetic forces. The slats may move vertically along a guide rail assembly as the slats move together.

Figure 4A:
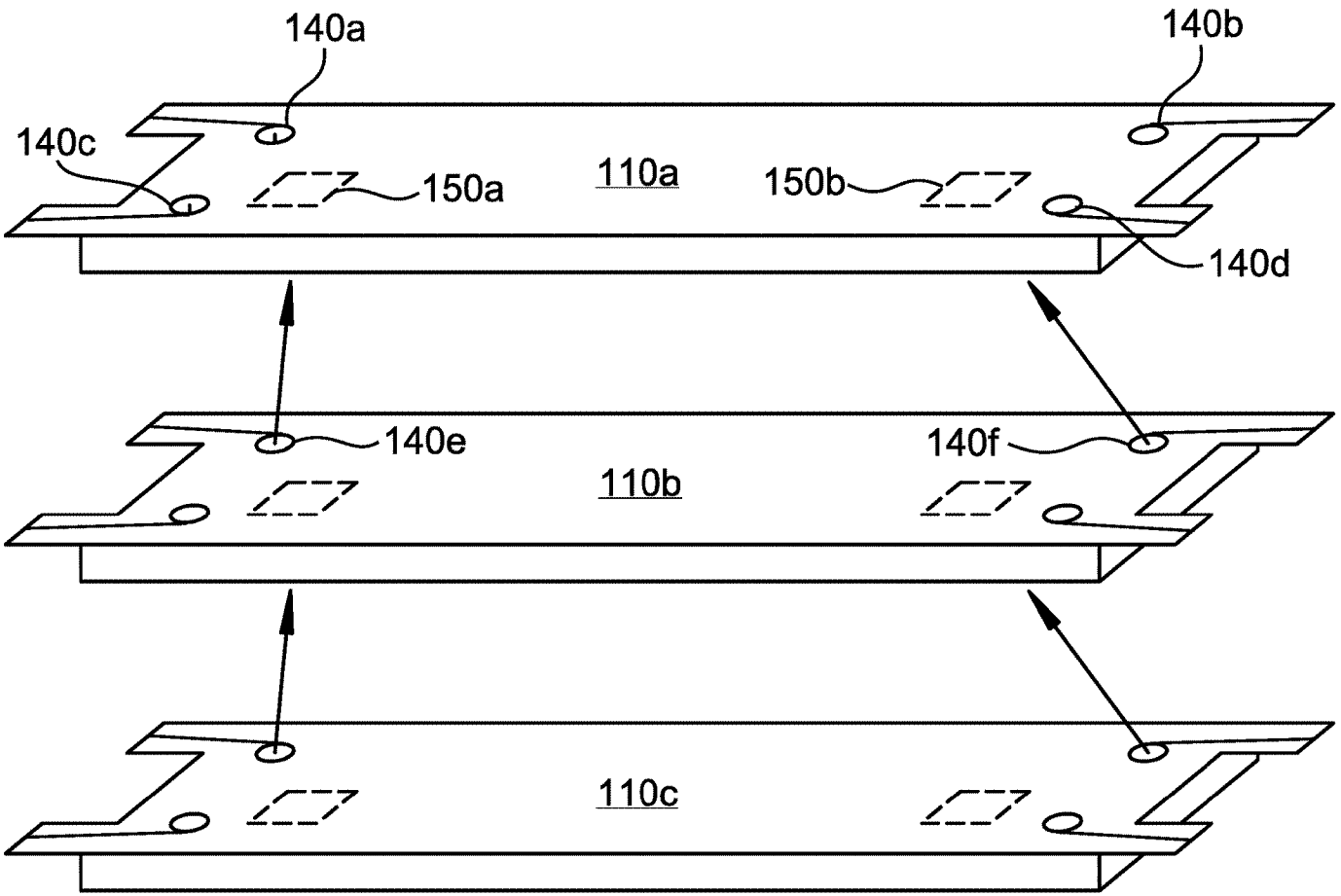
FIG. 4A illustrates the three slats of FIG. 1 in a fully open position just prior to tilting the slats.

FIG. 4A illustrates the slats of FIG. 1 with only the electromagnets on the rear longitudinal edge of each slat actuated. These include electromagnets 140*a* and 140*b* of slat 110*a* and electromagnets 140*e* and 140*f* of slat 110*b*. Arrows indicate the direction of the attractive magnetic forces. The electromagnets on the front longitudinal edges of the slats are not actuated and, therefore, provide no magnetic force. Instead of being attracted to an electromagnet directly above on an adjacent slat, the actuated electromagnets are attracted to the metal member on the bottom surface of the slat above each electromagnet. The electromagnetic attraction of the actuated electromagnet to the metal member is greater than the electromagnet attractions of the electromagnets to each other.

Figure 4B:
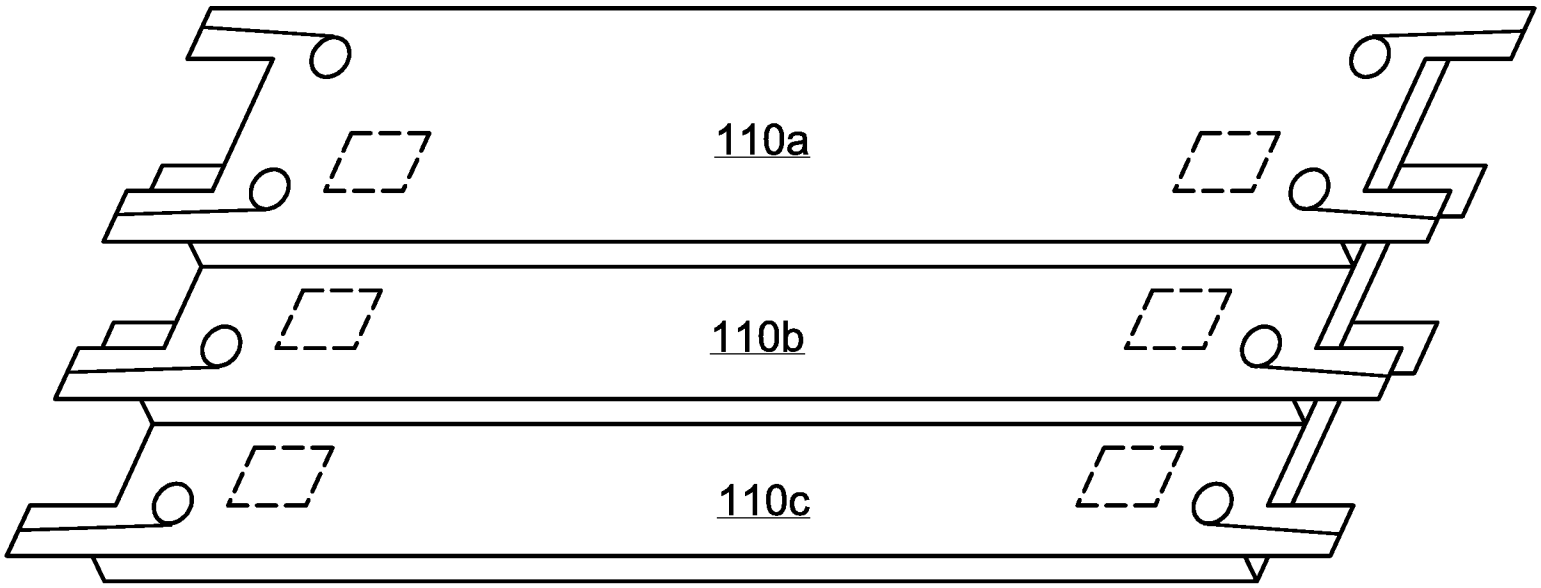
FIG. 4B illustrates the slats of FIG. 4A after the slats have been tilted to close the blinds.

FIG. 4B illustrates the slats of FIG. 4A after they have responded to the magnetic forces. The actuated electromagnets on the rear longitudinal edge of each slat and the adjacent metal member have moved together. The slats have moved to a closed position as if a tilt string had closed a traditional blind.

Figure 4C:
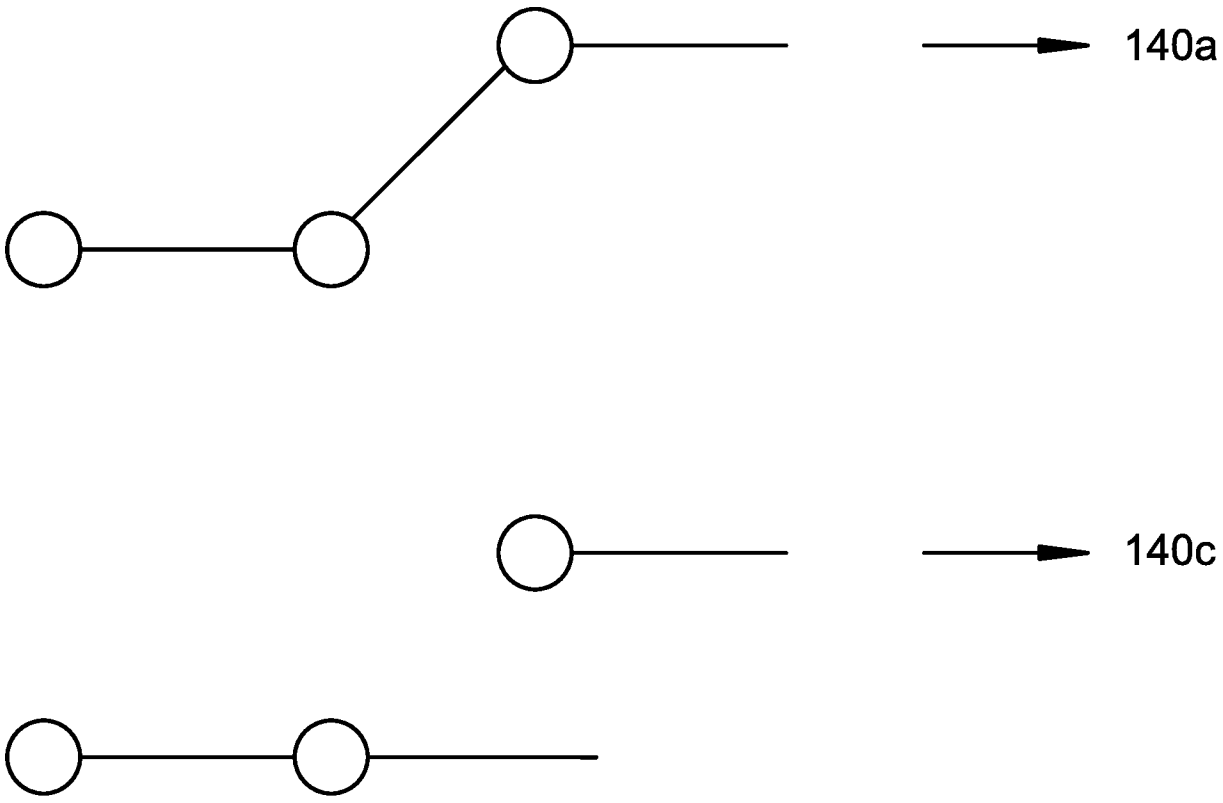
FIG. 4C illustrates a switch in an open and a closed position which may control the flow of current from a battery to one of the electromagnets.

FIG. 4C illustrates a switch that may be located along the electrical wiring between a battery and either electromagnet 140*a* as well as a switch that may be located along the electrical wiring between a battery and electromagnet 140*c*. When the switches are in the positions shown in FIG. 4C, the rear longitudinal edge of the slat is actuated and the front longitudinal edge of the slat is inactive as in FIGS. 4A and 4B. More specifically, the switch between the battery and electromagnet 140*c* is open so that no current flows to electromagnet 140*c*. Therefore, electromagnet 140*c* is not actuated.

Figure 5:
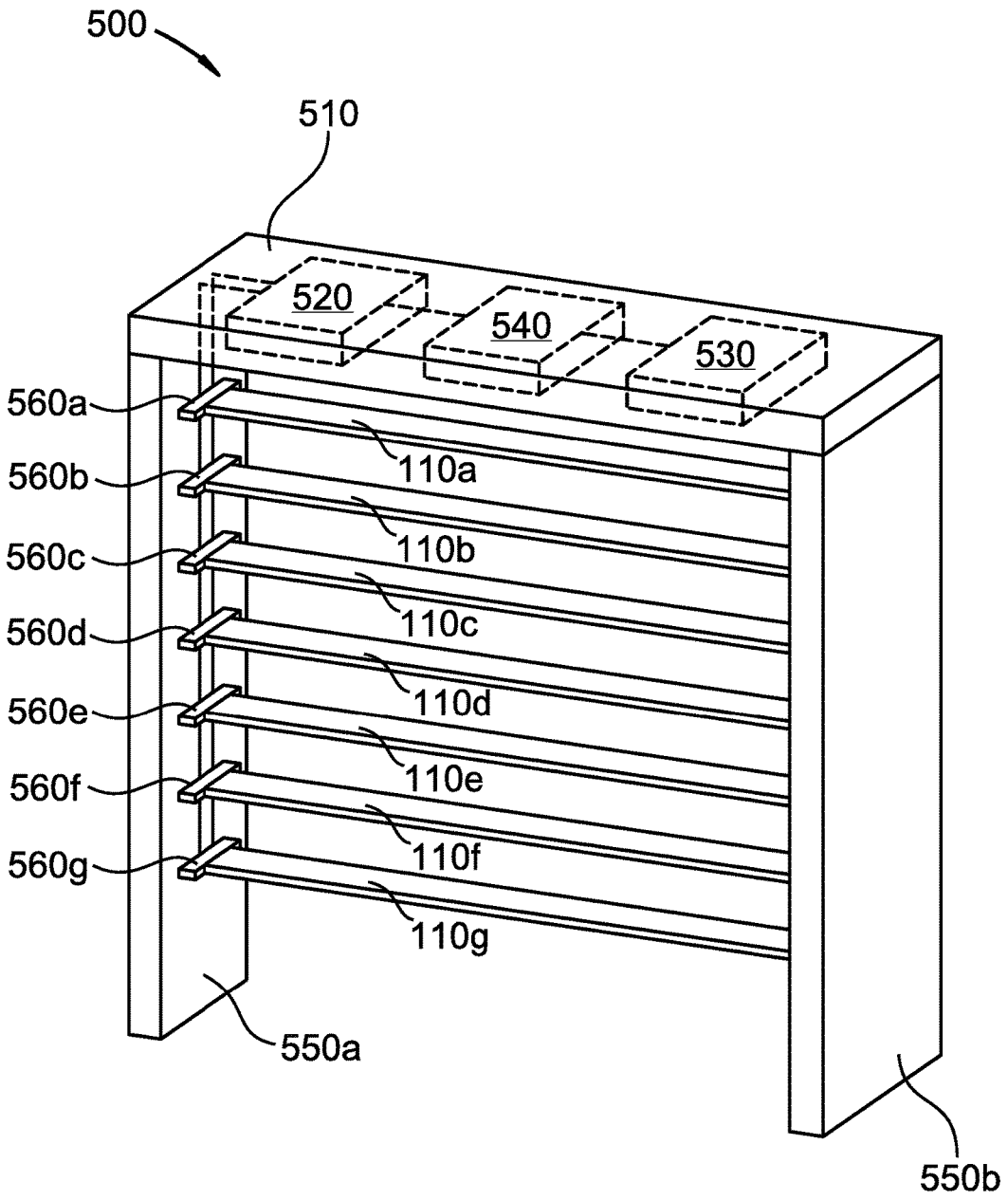
FIG. 5 illustrates an embodiment of a window blind according to the disclosure.

FIG. 5 illustrates window blind 500 according to the disclosure. Window blind 500 includes headrail 510 which includes batteries 520 and 530 as well as controller 540. Slats 110*a-g* are shown between side panels 550*a* and 550*b*. Slats 110*a-g* are shown inserted into orifices within rotatable slat mounting members 560*a-g* on side panel 550*a*. The opposite ends of slats 110*a-g* are similarly inserted into orifices into orifices within rotatable slat mounting members within side panel 550*b* although they are not visible from the angle shown.

Figure 6:
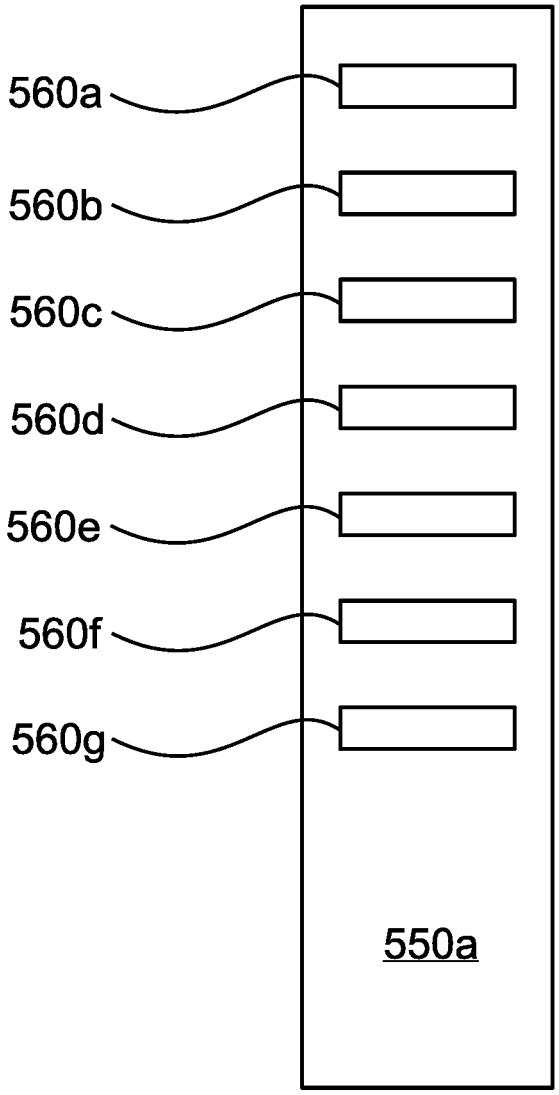
FIG. 6 illustrates a side panel with rotatable slat mounting members according to an embodiment of the invention.

FIG. 6 shows a direct view of side panel 550*a* with rotatable slat mounting members 560*a-g* more clearly visible. Two parallel guide rails (not shown) may be positioned on either side of the rotatable slat mounting members.

Figure 7:
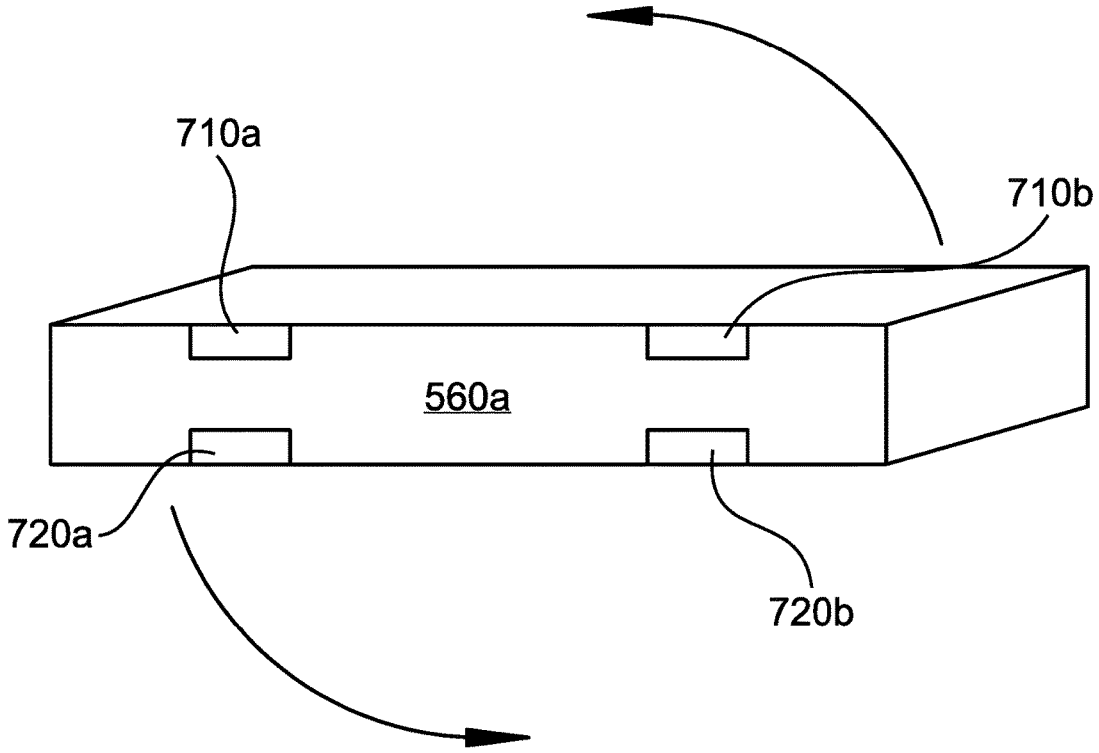
FIG. 7 illustrates an expanded view of one of the orifices of FIG. 6.

FIG. 7 illustrates rotatable slat mounting member 560*a*. Arrows indicate the direction rotatable slat mounting member 560*a* may rotate when the slats are tilting. Rotatable slat mounting member 560*a* includes an orifice into which the end of a slat (for example, slat 110*a*) may be inserted. Electrical connections 710*a* and 710*b* are shown within the orifice and may be in electrical connection with the ends of the wires which extend from the electromagnets 140*a* and 140*c* onto the top surface of slat 110*a*. Electrical connections 720*a* and 720*b* are also shown within the orifice and may be in electrical connection with the opposite ends of the wires which extend from the electromagnets 140*a* and 140*c* onto the bottom surface of slat 110*a*. Electrical connections 710*a*, 710*b*, 720*a*, and 720*b* may be in electrical connection with wires which lead to batteries and switches may be placed between the electrical connections and the batteries.

Figure 8:
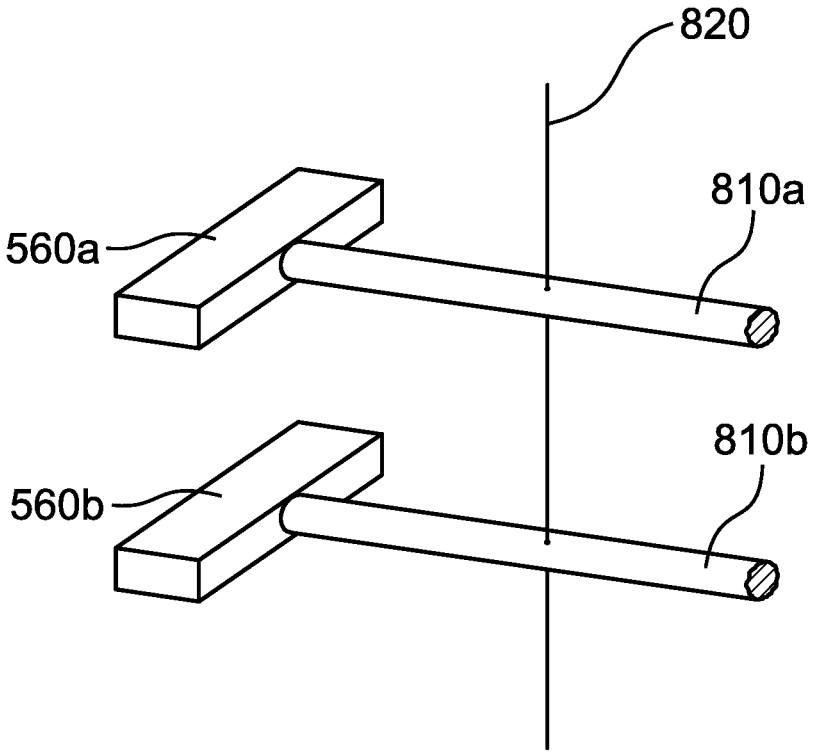
FIG. 8 illustrates two of the rotatable slat mounting members of FIG. 6, each attached to a rotatable rod according to an embodiment of the disclosure.

FIG. 8 illustrates rotatable slat mounting members 560*a* and 560*b* from a rear view. Rotatable slat mounting members 560*a* and 560*b* are each connected to axial shaft 810*a* and 810*b* respectively. Vertical wire 820 runs through axial shafts 810*a* and 810*b*. In some embodiments, rotatable wire may be enclosed with a housing surrounding a side panel. Rotatable slat mounting members 560*a* and 560*b* may freely turn on the end of axial shafts 810*a* and 810*b* respectively as the slats tilt (as in FIG. 4B) while axial shafts 810*a* and 810*b* may not rotate. The assembly of rotatable slat mounting member 560*a* and axial shaft 810*a* as well as the assembly of rotatable slat mounting member 560*b* and axial shaft 810*b* may move vertically along vertical wire 820 as the blinds are raised (as in FIG. 3B) and lowered.

While specific embodiments have been illustrated and described above, it is to be understood that the disclosure provided is not limited to the precise configuration, steps, and components disclosed. Various modifications, changes, and variations apparent to those of skill in the art may be made in the arrangement, operation, and details of the methods and systems disclosed, with the aid of the present disclosure.

Without further elaboration, it is believed that one skilled in the art can use the preceding description to utilize the present disclosure to its fullest extent. The examples and embodiments disclosed herein are to be construed as merely illustrative and exemplary and not a limitation of the scope of the present disclosure in any way. It will be apparent to those having skill in the art that changes may be made to the details of the above-described embodiments without departing from the underlying principles of the disclosure herein.

We claim:

1. A window blind comprising:
a headrail, the headrail comprising two ends;
one or more batteries;
a plurality of slats, each of the plurality of slats comprising:
a top surface;
a bottom surface;
two transverse edges;
a plurality of electromagnets, wherein each of the plurality of electromagnets is in electrical connection with one of the one or more batteries, and wherein each of the plurality of electromagnets has identical polarity;
at least one switch, wherein the at least one switch controls a current flowing from the one or more batteries to at least one of the plurality of electromagnets; and
two side panels, wherein one of the two side panels extends downward from each of the two ends of the headrail, and wherein each of the two side panels comprises:
a guide rail assembly, the guide rail assembly comprising:
two parallel guide rails;
a plurality of rotatable slat mounting members, wherein each of the plurality of rotatable slat mounting members is mounted between the two parallel guide rails, and wherein each of the plurality of rotatable slat mounting members comprises:
an orifice for inserting a slat; and
a plurality of electrical connections, wherein the plurality of electrical connections is located within the orifice.

2. The window blind of claim 1, wherein each of the plurality of slats further comprises at least two channels, wherein each of the at least two channels connects the top surface with the bottom surface of each of the plurality of slats, and wherein a core within each of the plurality of electromagnets is inserted into each of the at least two channels.

3. The window blind of claim 1, wherein each of the plurality of slats further comprises at least one metal member, wherein the at least one metal member comprises steel, iron, or a combination thereof.

4. The window blind of claim 3, wherein at least one of the at least one metal members is positioned on the bottom surface of each of the plurality of slats.

5. The window blind of claim 1, further comprising a plurality of tabs, wherein each tab comprises a top side and a bottom side, wherein each of the plurality of tabs extends from one of the two transverse edges.

6. The window blind of claim 5, wherein two of the plurality of tabs extend from each of the two transverse edges.

7. The window blind of claim 6, wherein each of the plurality of electromagnets comprises a wire coiled around a core, wherein each wire comprises a first end and a second end, wherein the first end of the wire is adjacent to the top side of each of the plurality of tabs, and where the second end of the wire is adjacent to the bottom side of each of the plurality of tabs.

8. The window blind of claim 7, wherein each of the plurality of tabs is inserted into the orifice for inserting a slat within one of the plurality of rotatable slat mounting members, wherein each of the first end of the coil of wire and the second end of the coil of wire are independently in electrical communication with one of the plurality of electrical connections within the orifice.

9. The window blind of claim 1, wherein the at least one switch completes a circuit between at least one of the one or more batteries and at least one of the plurality of electromagnets when the at least one switch is in a closed position, and wherein the at least one switch breaks the circuit between at least one of the one or more batteries and at least one of the plurality of electromagnets when the at least one switch is in an open position.

10. The window blind of claim 9, wherein the at least one switch comprises a plurality of switches, and wherein the plurality of switches comprises a plurality of designated switches, wherein each of the plurality of designated switches controls the current flowing from one of the one or more batteries to one of the plurality of electromagnets.

11. The window blind of claim 1, wherein the one or more batteries is positioned within the headrail.

12. The window blind of claim 1, wherein each of the plurality of electromagnets is positioned approximately in a corner of each of the plurality of slats.

13. The window blind of claim 1, wherein each of the plurality of slats comprises a front longitudinal edge and a rear longitudinal edge, and wherein at least one of the plurality of electromagnets is positioned along each of the front and the rear longitudinal edges.

14. The window blind of claim 13, further comprising a controller, wherein the controller is connected to and modulates the at least one switch.

15. The window blind of claim 14, wherein the controller closes the at least one switch controlling the current flowing to the at least one electromagnet positioned along the rear longitudinal edge of at least one of the plurality of slats and opens the at least one switch controlling the current flowing to the at least one electromagnet positioned along the front longitudinal edge of at least one of the plurality of slats.

16. The window blind of claim 15, wherein the at least one electromagnet is positioned along the rear longitudinal edge of a first slat of the plurality of slats attracts the at least one metal member on a second slat of the plurality of slats causing the rear longitudinal edge of the first slat and the second slat to move closer together, and wherein the first slat is adjacent to and below the second slat.

17. The window blind of claim 16, wherein the front longitudinal edge of the first slat connects with the second slat.

18. The window blind of claim 14, wherein the controller closes the at least one switch controlling the current flowing to each of the plurality of electromagnets.

19. The window blind of claim 18, wherein the plurality of electromagnets of the plurality of slats attract each other, and wherein the plurality of slats move vertically along the guide rail assembly.

20. The window blind of claim 19, wherein a top slat of the plurality of slats is vertically immobile.

* * * * *